US007551868B2

(12) United States Patent
Yasutomi et al.

(10) Patent No.: US 7,551,868 B2
(45) Date of Patent: Jun. 23, 2009

(54) IMAGE FORMING APPARATUS AND IMAGE FORMING METHOD

(75) Inventors: Kei Yasutomi, Yokohama (JP); Hitoshi Maruyama, Tokyo (JP); Reki Nakamura, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 11/822,821

(22) Filed: Jul. 10, 2007

(65) Prior Publication Data

US 2008/0013975 A1 Jan. 17, 2008

(30) Foreign Application Priority Data

Jul. 11, 2006 (JP) ..... 2006-190228

(51) Int. Cl.
*G03G 15/20* (2006.01)

(52) U.S. Cl. ..... 399/67; 219/216; 399/45; 399/82; 399/341; 430/124.1

(58) Field of Classification Search ..... 399/67, 399/68, 69, 45, 81, 82, 320, 322, 341, 342; 347/156; 219/216; 430/124.1
See application file for complete search history.

(56) References Cited

U.S. PATENT DOCUMENTS

| | | | | |
|---|---|---|---|---|
| 7,024,149 | B2 * | 4/2006 | Kito et al. | 399/341 |
| 2004/0042809 | A1 * | 3/2004 | Fuma et al. | 399/67 |
| 2005/0196203 | A1 * | 9/2005 | Tsuda et al. | 399/341 |
| 2005/0214004 | A1 * | 9/2005 | Toyohara et al. | 399/45 |
| 2007/0086803 | A1 * | 4/2007 | Kimura et al. | 399/69 |

FOREIGN PATENT DOCUMENTS

| | | | |
|---|---|---|---|
| JP | 61-122665 | | 6/1986 |
| JP | 61-122666 | | 6/1986 |
| JP | 61-149966 | | 7/1986 |
| JP | 63-092965 | | 4/1988 |
| JP | 63-149683 | | 6/1988 |
| JP | 04-342277 | | 11/1992 |
| JP | 04-344680 | A * | 12/1992 |
| JP | 04-369677 | | 12/1992 |
| JP | 05-249724 | | 9/1993 |
| JP | 05-338039 | | 12/1993 |
| JP | 09-150456 | | 6/1997 |
| JP | 2000-136968 | | 5/2000 |
| JP | 2001-222171 | | 8/2001 |
| JP | 2002-091048 | | 3/2002 |
| JP | 2002-206972 | | 7/2002 |
| JP | 2002-372882 | | 12/2002 |
| JP | 2003-076096 | | 3/2003 |
| JP | 2003-076201 | | 3/2003 |
| JP | 2004-294575 | | 10/2004 |
| JP | 2005-283654 | | 10/2005 |

* cited by examiner

*Primary Examiner*—Sophia S Chen
(74) *Attorney, Agent, or Firm*—Harness, Dickey & Pierce, P.L.C.

(57) ABSTRACT

An image forming apparatus is disclosed, including a fixing device and a sheet storing member. The fixing device performs both tentative fixing and regular fixing. In at least one embodiment, the fixing device performs tentative fixing for tentatively fixing a toner image on a recording sheet. Further, the fixing device performs regular fixing for further fixing the tentatively fixed toner image by contacting a gloss sheet onto the tentatively fixed toner image on the recording sheet. The sheet storing member temporarily stores the recording sheet bearing the tentatively fixed toner image before the recording sheet is sent to the fixing device for the further fixing.

20 Claims, 6 Drawing Sheets

IMAGE FORMING APPARATUS AND IMAGE FORMING METHOD

PRIORITY STATEMENT

The present patent application claims priority of Japanese Patent Application No. 2006-190228 filed on Jul. 11, 2006 in the Japan Patent Office, the entire contents of which are incorporated by reference herein.

BACKGROUND

1. Technical Field

Some example embodiments generally relate to an image forming apparatus and/or an image forming method, for example, for fixing a toner image on a recording medium.

2. Description of Background Art

A background image forming apparatus, for example, a copying machine, a facsimile machine, a printer, or a multi-function printer having copying, printing, scanning, and facsimile functions, forms a toner image on a recording medium (e.g., a sheet) according to image data by an electrophotographic method. For example, a charger charges a surface of an image carrier (e.g., a photoconductor). An optical device emits a light beam onto the charged surface of the photoconductor to form an electrostatic latent image on the photoconductor according to image data. The electrostatic latent image is developed with a developer (e.g., toner) to form a toner image on the photoconductor. A transfer device transfers the toner image formed on the photoconductor onto a sheet. A fixing device applies heat and pressure to the sheet bearing the toner image to fix the toner image on the sheet. The sheet bearing the fixed toner image is output onto an outside of the image forming apparatus.

An example fixing device includes a fixing roller pair (e.g., a heating roller and/or a pressing roller). A heat source (e.g., a halogen lamp) is disposed inside the heating roller. When a sheet bearing a toner image passes a nip formed between the heating roller and the pressing roller, the fixing roller pair melts and fixes the toner image on the sheet.

Another example fixing device includes a fixing belt looped over a plurality of support rollers. A pressing roller opposes one of the support rollers via the fixing belt. A heat source (e.g., a halogen lamp) is disposed inside the support roller. When a sheet bearing a toner image passes a nip formed between the fixing belt and the pressing roller, the fixing belt and the pressing roller melt and fix the toner image on the sheet.

The fixed toner image may have increased surface asperities scattering incident and output lights, resulting in a toner image having a decreased saturation and a color reproduction.

An image forming apparatus may form a high quality image on a sheet having decreased surface asperities and an increased gloss (e.g., art paper, coated paper, light weight coated paper, and/or the like). When a toner image having increased surface asperities and a decreased gloss is formed on a sheet having decreased surface asperities and an increased gloss, the toner image and the sheet have glosses different from each other, respectively, resulting in formation of a faulty toner image having a decreased uniform gloss.

For example, a halftone image on a sheet includes a toner area bearing toner and a non-toner area not bearing toner and thereby exposing a sheet. A halftone image having a small image area rate has an increased gloss equivalent to a gloss of a sheet because the halftone image bears a small amount of toner. A halftone image having a medium image area rate has a decreased gloss because the halftone image bears a great amount of toner. A halftone image having a large image area rate has a gloss varying depending on a melting condition of toner. Thus, the sheet bearing the halftone image has various glosses, resulting in formation of a faulty toner image.

To address this problem, an example background fixing device applies heat and pressure to a sheet bearing a fixed toner image to further fix the toner image in a state that a film contacts the toner image on the sheet. After the toner image is cooled down, the film is separated from the sheet, so as to increase a gloss of the toner image. However, the example background fixing device may include two fixing devices, resulting in a large size image forming apparatus.

Another example background fixing device uses a fixing belt to apply heat and pressure to a sheet bearing a toner image so as to fix the toner image on the sheet. The sheet bearing the fixed toner image is cooled down while the sheet is conveyed on the fixing belt in a state that the fixed toner image contacts the fixing belt. The cooled sheet is separated from the fixing belt. A plane surface of the fixing belt decreases surface asperities of the toner image and increases a gloss of the toner image. However, the fixing belt may have a large size in a sheet conveyance direction to cool down the sheet, resulting in a large size fixing device or image forming apparatus. The fixing belt may be alternately heated to fix a toner image on a sheet and cooled to cool down the sheet, preventing energy saving. Further, the fixing belt may not rotate at a high speed to cool down the sheet, resulting in a decreased productivity at a decreased print speed. A sheet bearing a toner image contacts and scrapes the plane surface of the fixing belt even when the plane surface of the fixing belt does not need to increase a gloss of the toner image, resulting in wear of the fixing belt. Thus, the fixing belt may not increase a gloss of a toner image on a sheet for a long time period.

SUMMARY

At least one embodiment may provide an image forming apparatus that includes a fixing device and a sheet storing member. The fixing device performs both tentative fixing and regular fixing. In a first fixing process, the fixing device performs tentative fixing for tentatively fixing a toner image on a recording sheet. In a second fixing process, the fixing device performs regular fixing for further fixing the toner image tentatively fixed in the first fixing process by contacting a gloss sheet onto the tentatively fixed toner image on the recording sheet. The sheet storing member temporarily stores the recording sheet bearing the toner image tentatively fixed in the first fixing process before the recording sheet is sent to the fixing device for the second fixing process.

At least one embodiment may provide an image forming method that includes tentatively fixing a toner image on a recording sheet in a first fixing process with a fixing device, and sending the recording sheet bearing the toner image tentatively fixed in the first fixing process to a sheet storing member. The method further includes temporarily storing the recording sheet sent from the fixing device in the sheet storing member. The method further includes sending the recording sheet from the sheet storing member to the fixing device. The method further includes regular-fixing the toner image tentatively fixed in the first fixing process by contacting a gloss sheet onto the tentatively fixed toner image on the recording sheet in a second fixing process, with the fixing device used in the first fixing process.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
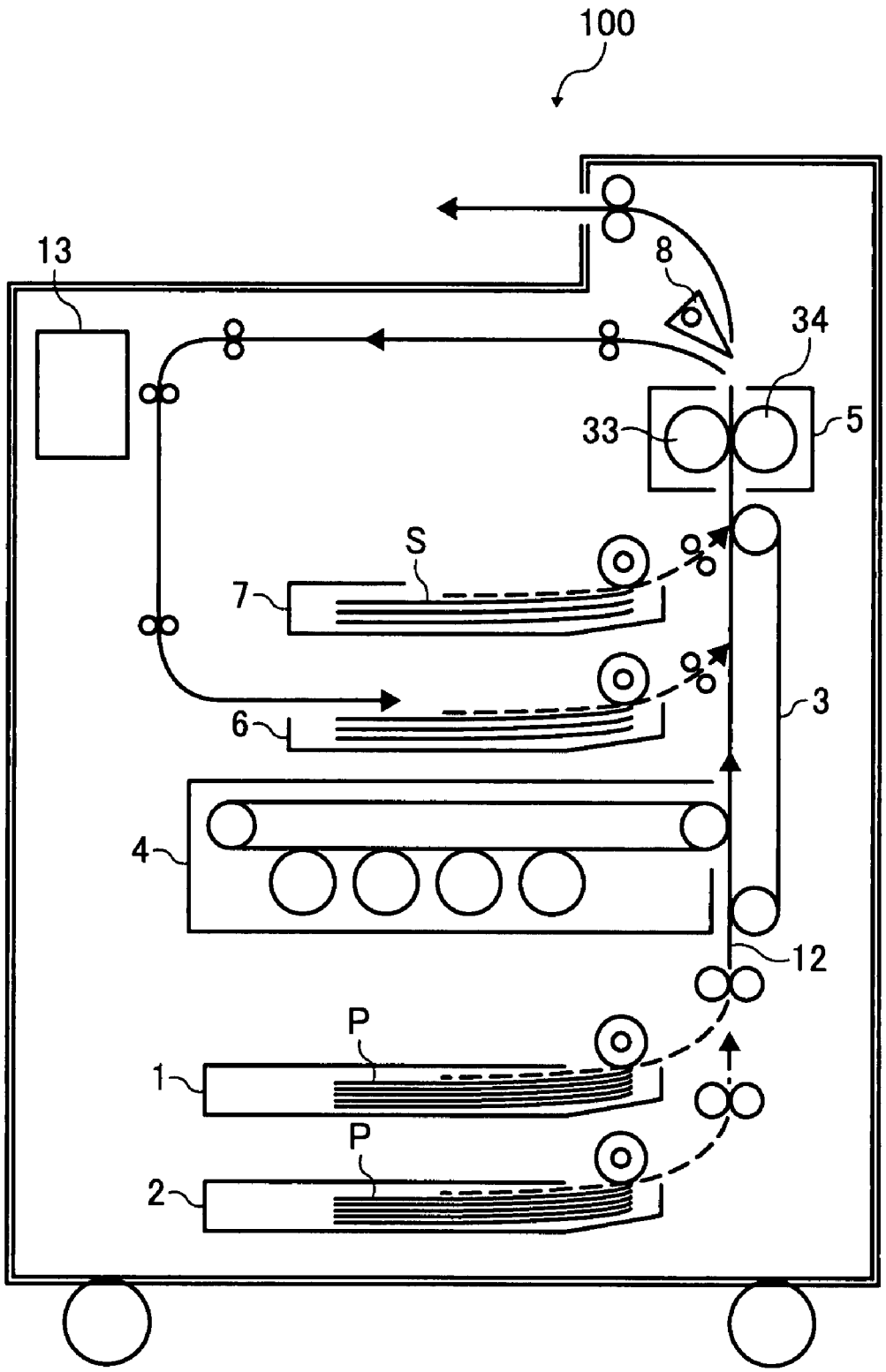
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

As illustrated in FIG. 1, the image forming apparatus 100 includes paper trays 1 and 2, a conveying path 12, a conveying belt 3, an image forming device 4, a fixing device 5, a conveyance path selector 8, a storing tray 6, a gloss sheet tray 7, and/or a controller 13. The fixing device 5 includes a fixing roller 33 and/or a pressing roller 34.

The image forming apparatus 100 may be a copying machine, a facsimile machine, a printer, a multifunction printer including copying, printing, scanning, and facsimile functions, or the like. According to this non-limiting example embodiment, the image forming apparatus 100 functions as a color printer for forming a color image on a recording medium by an electrophotographic method.

The paper trays 1 and 2 are disposed in a lower portion of the image forming apparatus 100. The paper trays 1 and 2 load a recording sheet (e.g., a sheet P). The sheet P may include information paper, coated paper, and/or non-coated paper. The information paper may include office automation paper (e.g., plain paper and/or the like) generally used for a copying machine, a printer, and/or the like. The coated paper may include cast-coated paper, art paper, and/or light weight coated paper. The non-coated paper may include high quality paper, medium quality paper, and/or low quality paper. The sheet P may further include an OHP (overhead projector) transparency formed of a plastic material (e.g., polyethylene terephthalate and/or the like).

The image forming apparatus 100 may form a toner image having a uniform, high gloss. Therefore, the image forming apparatus 100 may use coated paper having small surface asperities or special paper including a thermoplastic resin on its surface into which a toner layer is embedded to form a smooth toner image.

A sheet P fed from the paper tray 1 or 2 is conveyed on the conveying path 12 toward an upper portion of the image forming apparatus 100. The conveying belt 3 conveys the sheet P in a state that a surface of the conveying belt 3 supports the sheet P. The image forming device 4 forms and superimposes yellow, cyan, magenta, and black toner images to form a color toner image, and transfers the color toner image onto the sheet P conveyed on the conveying belt 3. The conveying belt 3 conveys the sheet P bearing the color toner image toward the upper portion of the image forming apparatus 100.

The sheet P bearing the color toner image (e.g., the sheet P having a toner layer on its surface) is conveyed to the fixing device 5. While the sheet P is conveyed in the fixing device 5, heat and pressure are applied on the sheet P bearing the color toner image to fix the color toner image on the sheet P. For example, in the fixing device 5, the fixing roller 33 faces the color toner image on the sheet P. The fixing roller 33 has a diameter of about 30 mm and includes a tube, an elastic layer, and/or a releasing layer. The tube includes aluminum. The elastic layer includes a liquid silicon rubber and is formed on the tube. The releasing layer includes fluoroplastic (e.g., PTFE (polytetrafluoroethylene) and/or the like) and forms a surface layer of the fixing roller 33. The pressing roller 34 has a diameter of about 30 mm and includes a core, an elastic layer and/or a releasing layer. The core includes aluminum. The elastic layer includes a silicon rubber and is formed on the core. The releasing layer includes fluoroplastic (e.g., PTFE and/or the like) and forms a surface layer of the pressing roller 34. According to this non-limiting example embodiment, this first fixing operation is referred to as tentative fixing and a process for performing the tentative fixing is referred to as a first fixing process.

The conveyance path selector 8 guides the sheet P bearing the tentatively fixed color toner image toward the storing tray 6. For example, the sheet P is conveyed downward in the upper portion of the image forming apparatus 100. The storing tray 6 serves as a sheet storing member for storing the sheet P conveyed from the fixing device 5. For example, sheets P bearing a tentatively fixed color toner image are stored in the storing tray 6 as needed.

A sheet P bearing a tentatively fixed color toner image is fed from the storing tray 6 to return to the conveying path 12, and is conveyed toward the fixing device 5 again. The gloss sheet tray 7 loads a gloss sheet S. A gloss sheet S is fed from the gloss sheet tray 7 at a proper time when the gloss sheet S is superimposed on the tentatively fixed color toner image on the sheet P. The sheet P is conveyed to the fixing device 5 in a state that the gloss sheet S is superimposed on the sheet P. While the sheet P is conveyed in the fixing device 5, heat and pressure are applied to the tentatively fixed color toner image on the sheet P to fix the tentatively fixed color toner image on the sheet P. For example, a surface of the toner image is deformed to correspond to a surface of the sheet P. According to this non-limiting example embodiment, this second fixing operation is referred to as regular fixing and a process for performing the regular fixing is referred to as a second fixing process. The sheet P bearing the regular-fixed color toner image is conveyed together with the gloss sheet S. For example, the conveyance path selector 8 guides the sheet P toward an outside of the image forming apparatus 100. Thus, the sheet P and the gloss sheet S are output onto the outside of the image forming apparatus 100.

A user picks up the sheet P output on the outside of the image forming apparatus 100, and separates (e.g., strips) the gloss sheet S from the sheet P. Thus, the toner image having a smooth surface is formed on the sheet P. The toner image appearing on the sheet P after the gloss sheet S is removed may provide a high quality image having an improved color reproduction and an increased image density. Namely, the image forming apparatus 100 may produce a high quality image.

The controller 13 controls operations of the image forming apparatus 100.

As described above, the image forming apparatus 100 includes the fixing device 5 which performs the first and second fixing processes. The image forming apparatus 100 further includes the storing tray 6 which temporarily stores a sheet P bearing a color toner image tentatively fixed in the first fixing process.

Figure 2:
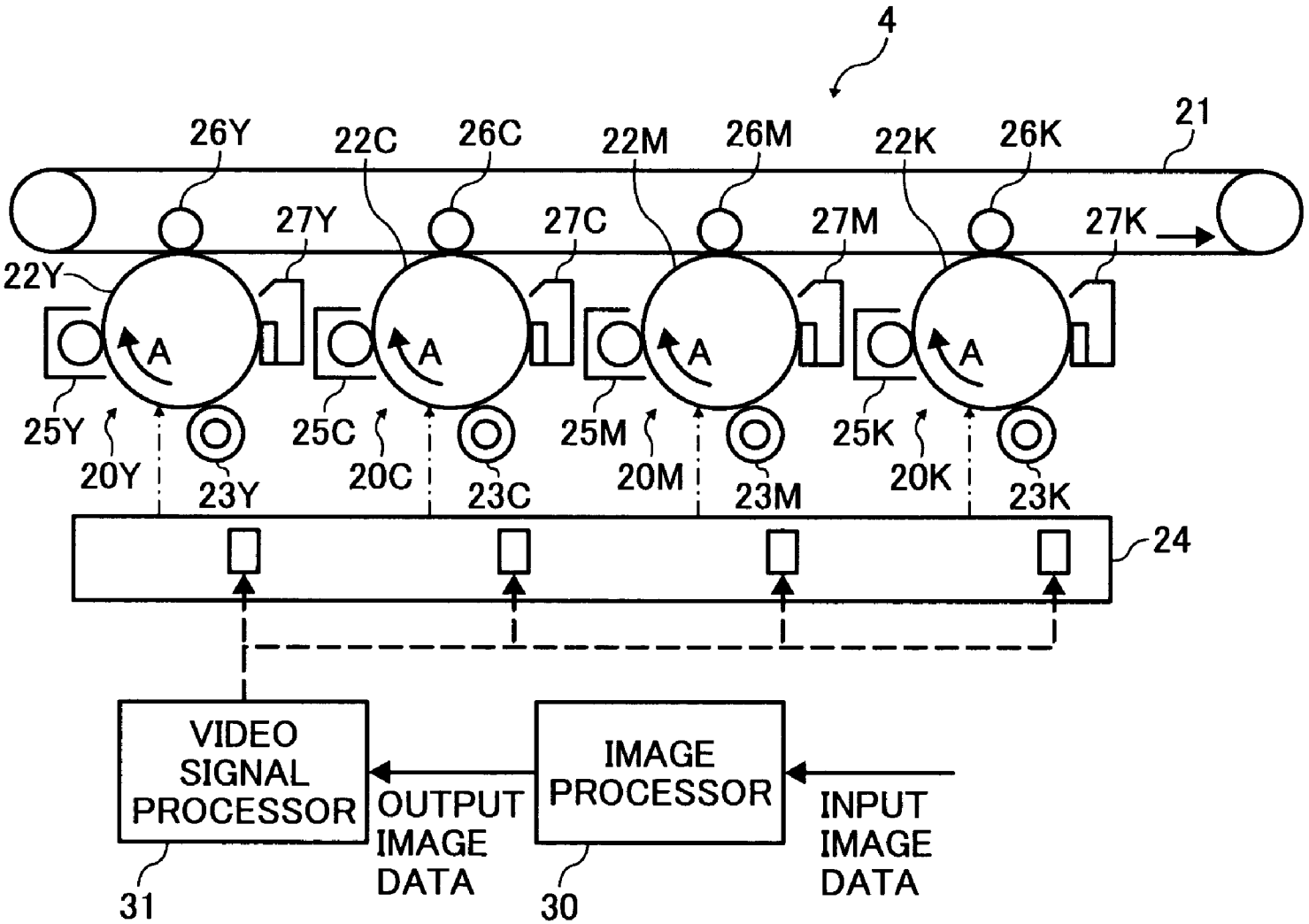
FIG. 2 is an enlarged schematic view (according to an example embodiment) of an image forming device of the image forming apparatus shown in FIG. 1.

Referring to FIG. 2, the following describes the image forming device 4. As illustrated in FIG. 2, the image forming device 4 includes four image forming units 20Y, 20C, 20M, and 20K, an intermediate transfer belt 21, an optical unit 24, an image processor 30, and/or a video signal processor 31. The image forming unit 20Y includes a photoconductor 22Y, a charger 23Y, a developing device 25Y, a first transfer member 26Y, and/or a cleaner 27Y. The image forming unit 20C includes a photoconductor 22C, a charger 23C, a developing device 25C, a first transfer member 26C, and/or a cleaner 27C. The image forming unit 20M includes a photoconductor 22M, a charger 23M, a developing device 25M, a first transfer member 26M, and/or a cleaner 27M. The image forming unit 20K includes a photoconductor 22K, a charger 23K, a developing device 25K, a first transfer member 26K, and/or a cleaner 27K.

The image forming device 4 superimposes toner images having four color components (e.g., yellow, cyan, magenta, and black) respectively on a sheet P to form a color toner image on the sheet P. As illustrated in FIG. 2, the image forming units 20Y, 20C, 20M, and 20K are arranged in this order along the intermediate transfer belt 21, and form yellow, cyan, magenta, and black toner images, respectively. The intermediate transfer belt 21 has a belt-like shape and contacts the four image forming units 20Y, 20C, 20M, and 20K. The yellow, cyan, magenta, and black toner images formed by the image forming units 20Y, 20C, 20M, and 20K, respectively, are transferred onto the intermediate transfer belt 21. A driver (not shown) rotates the intermediate transfer belt 21 at a reference time. For example, the yellow, cyan, magenta, and black toner images are superimposed at a reference position on the intermediate transfer belt 21. The superimposed toner images are transferred from the intermediate transfer belt 21 onto a sheet P conveyed on the conveying belt 3 (depicted in FIG. 1). Thus, a color toner image is formed on the sheet P.

The four image forming units 20Y, 20C, 20M, and 20K have a common structure. Therefore, the following describes the image forming unit 20Y. The photoconductor 22Y rotates in a rotating direction A. The charger 23Y charges the photoconductor 22Y to have a reference electric potential. The optical unit 24 emits light onto the charged photoconductor 22Y according to print image data (e.g., image data on which image processing is performed) so as to form an electrostatic latent image on the photoconductor 22Y. The developing device 25Y develops the electrostatic latent image with a toner in a corresponding color (e.g., a yellow toner in the image forming unit 20Y) so as to form a yellow toner image on the photoconductor 22Y. The first transfer member 26Y transfers the yellow toner image from the photoconductor 22Y onto the intermediate transfer belt 21. The cleaner 27Y removes residual yellow toner not transferred onto the intermediate transfer belt 21 and thereby remaining on the photoconductor 22Y from the photoconductor 22Y.

The image processor 30 includes an MTF (modulation transfer function) filter processor (not shown), a gray-scale correction processor (not shown), and/or a pseudo-halftone processor (not shown). Input image data may be sent from a personal computer (not shown). Alternatively, input image data may be sent from an image scanner (not shown) when the image forming apparatus 100 functions as a copying machine. The input image data generally includes RGB (red, green, blue) multi-valued image data (e.g., 8-bit image data). The MTF filter processor performs enhancement processing on the input image data and color conversion processing for converting the enhanced image data in an RGB color space into image data in a CMYK (cyan, magenta, yellow, black) color space. The gray-scale correction processor (e.g., a γ converter) performs density control on the converted image data so that the image data has a reference gray scale. The pseudo-halftone processor performs pseudo-halftone processing so that the image data has a reference print property. The image processor 30 sends the processed image data (e.g., 600-dpi, 4-bit output image data) to the video signal processor 31.

The video signal processor 31 includes video signal processors for yellow, cyan, magenta, and black image data having a common structure. Therefore, the following describes a video signal processor for yellow image data.

When the video signal processor 31 (e.g., a video signal processor for yellow image data) receives output image data (e.g., processed image data), the output image data is stored in line memories (not shown) provided in accordance with the number of light emitters (e.g., laser diodes). The image data stored in the line memories and corresponding to each pixel is sent to a PWM (pulse width modulation) controller (not shown) at a reference time (e.g., a pixel clock) in accordance with a signal (e.g., a synchronous signal) synchronizing with rotation of a polygon mirror (not shown). According to this non-limiting example embodiment, one light emitter is provided for each of yellow, cyan, magenta, and black image data. The PWM controller converts the image data into a pulse width modulation signal and sends the pulse width modulation signal to an LD (laser diode) driver (not shown). The LD driver performs optical modulation driving on an LD element (e.g., an LD array) with a reference light quantity in accordance with the pulse width modulation signal. According to this non-limiting example embodiment, the PWM controller performs pulse width modulation control corresponding to output image data for each of yellow, cyan, magenta, and black colors so as to perform optical modulation driving of laser beams.

A collimate lens (not shown) shapes light beams emitted by the LD element into parallel light beams. An aperture (not shown) shapes the parallel light beams into a light flux having a reference beam diameter. The light flux passes a cylindrical lens (not shown) and irradiates the polygon mirror. The polygon mirror reflects the light flux toward a scanning lens (not shown), such as an fθ lens. The fθ lens gathers the reflected light flux. A deflecting mirror (not shown) deflects the gathered light flux toward the photoconductor 22Y so that the deflected light flux forms an electrostatic latent image on the photoconductor 22Y. As described above, the electrostatic latent image is developed with a yellow toner into a yellow toner image. The yellow toner image is transferred and superimposed on the intermediate transfer belt 21 together with cyan, magenta, and black toner images formed on the photoconductors 22C, 22M, and 22K, respectively. The superimposed yellow, cyan, magenta, and black toner images are further transferred from the intermediate transfer belt 21 onto a sheet P.

The following describes a toner used in the image forming apparatus 100 (depicted in FIG. 1). The toner (e.g., a polymerized toner) is produced by a polymerization method. The toner includes a wax serving as a releasing agent so that the fixing device 5 (depicted in FIG. 1) may perform oilless fixing in the first fixing process and a sheet P bearing a toner image may be easily separated from a gloss sheet S after the second fixing process. The toner has a volume average particle size of about 5.5 μm. The particle size of the toner was measured with a particle sizing and counting analyzer, Coulter Counter TAII, available from Beckman Coulter, Inc., having an aperture diameter of about 100 μm. Yellow, cyan, magenta, and black toners are produced by a common method. However, a toner used in the image forming apparatus 100 is not limited to the toner produced as described above, and may be produced by a method other than the polymerization method, for example, a dispersion polymerization method or a pulverization method.

A gloss sheet S has a size equivalent to or greater than a size of a sheet P. According to this non-limiting example embodiment, the gloss sheet S and the sheet P have a common size (e.g., an A4 size). For example, the gloss sheet S includes a PET (polyethylene terephthalate) material having a thickness of about 70 μm and a surface roughness of about 0.2 μm. However, the gloss sheet S may include a material (e.g., polyimide, polyester, polypropylene, and/or the like) other than the PET material to provide effects common to the effects provided by the PET material. According to this non-limiting example embodiment, the gloss sheet S includes a single layer. However, the gloss sheet S may include a plurality of layers.

Referring to FIG. 1, the following describes an example configuration of the image forming apparatus 100. For example, in the first fixing process, the fixing roller 33 has a temperature of about 170 degrees centigrade. A sheet P passes a nip formed between the fixing roller 33 and the pressing roller 34 at a speed of about 200 mm/sec, so that a toner image on the sheet P is tentatively fixed. In the second fixing process in which the fixing device 5 performs regular fixing for fixing the tentatively fixed toner image on the sheet P in a state that a gloss sheet S contacts the toner image on the sheet P, the fixing roller 33 has a temperature of about 185 degrees centigrade. The sheet P passes the nip formed between the fixing roller 33 and the pressing roller 34 at a speed of about 200 mm/sec in a state that the gloss sheet S contacts the toner image on the sheet P.

While the storing tray 6 stores the sheet P bearing the tentatively fixed toner image, the controller 13, serving as a fixing condition controller, changes a fixing condition of the fixing device 5. For example, the controller 13 changes a fixing temperature of the fixing device 5 from about 170 degrees centigrade to about 185 degrees centigrade while the storing tray 6 stores the sheet P bearing the tentatively fixed toner image.

Referring to FIG. 1, the following describes another example configuration of the image forming apparatus 100. In the above-described example configuration, the controller 13 changes the fixing temperature of the fixing device 5. However, in this example configuration, the controller 13 changes a fixing speed of the fixing device 5. For example, in the first fixing process, the fixing roller 33 has a temperature of about 170 degrees centigrade. A sheet P passes the nip formed between the fixing roller 33 and the pressing roller 34 at a speed of about 200 mm/sec, so that a toner image on the sheet P is tentatively fixed. In the second fixing process, the fixing roller 33 maintains the temperature of about 170 degrees centigrade. The sheet P passes the nip formed between the fixing roller 33 and the pressing roller 34 at a speed of about 100 mm/sec in a state that a gloss sheet S contacts the toner image on the sheet P.

According to the above-described example configurations of the image forming apparatus 100, a toner image on a sheet P, after a gloss sheet S is removed from the sheet P, may provide a high quality image having an improved color reproduction and an increased image density. Namely, the image forming apparatus 100 may produce a high quality image.

Referring to FIG. 1, the following describes yet another example configuration of the image forming apparatus 100. In this example configuration, the controller 13 changes a pressure applied to a sheet P at the nip formed between the fixing roller 33 and the pressing roller 34 of the fixing device 5. For example, in the first fixing process, the fixing roller 33 has a temperature of about 170 degrees centigrade. A sheet P passes the nip formed between the fixing roller 33 and the pressing roller 34 at a speed of about 200 mm/sec, so that a toner image on the sheet P is tentatively fixed. The nip formed between the fixing roller 33 and the pressing roller 34 has a length of about 8 mm in a sheet conveyance direction. At the nip formed between the fixing roller 33 and the pressing roller 34, a pressure of about 0.3 MPa is applied to the sheet P. In the second fixing process, the fixing roller 33 has a temperature of about 185 degrees centigrade. At the nip formed between the fixing roller 33 and the pressing roller 34, a pressure of about 0.5 MPa is applied to the sheet P. Accordingly, the nip formed between the fixing roller 33 and the pressing roller 34 has a length of about 9 mm in the sheet conveyance direction. The sheet P passes the nip formed between the fixing roller 33 and the pressing roller 34 at a speed of about 200 mm/sec in a state that a gloss sheet S contacts the toner image on the sheet P.

According to this non-limiting example configuration of the image forming apparatus 100, a toner image on a sheet P, after a gloss sheet S is removed from the sheet P, may provide a high quality image having an improved color reproduction and an increased image density. The increased pressure applied in the second fixing process causes the toner image to be properly buried in the sheet P at a position where the toner image carries a decreased amount of toner. Thus, the toner image has a smooth surface. Namely, the image forming apparatus 100 may produce a high quality image having an improved surface smoothness.

Figure 3:
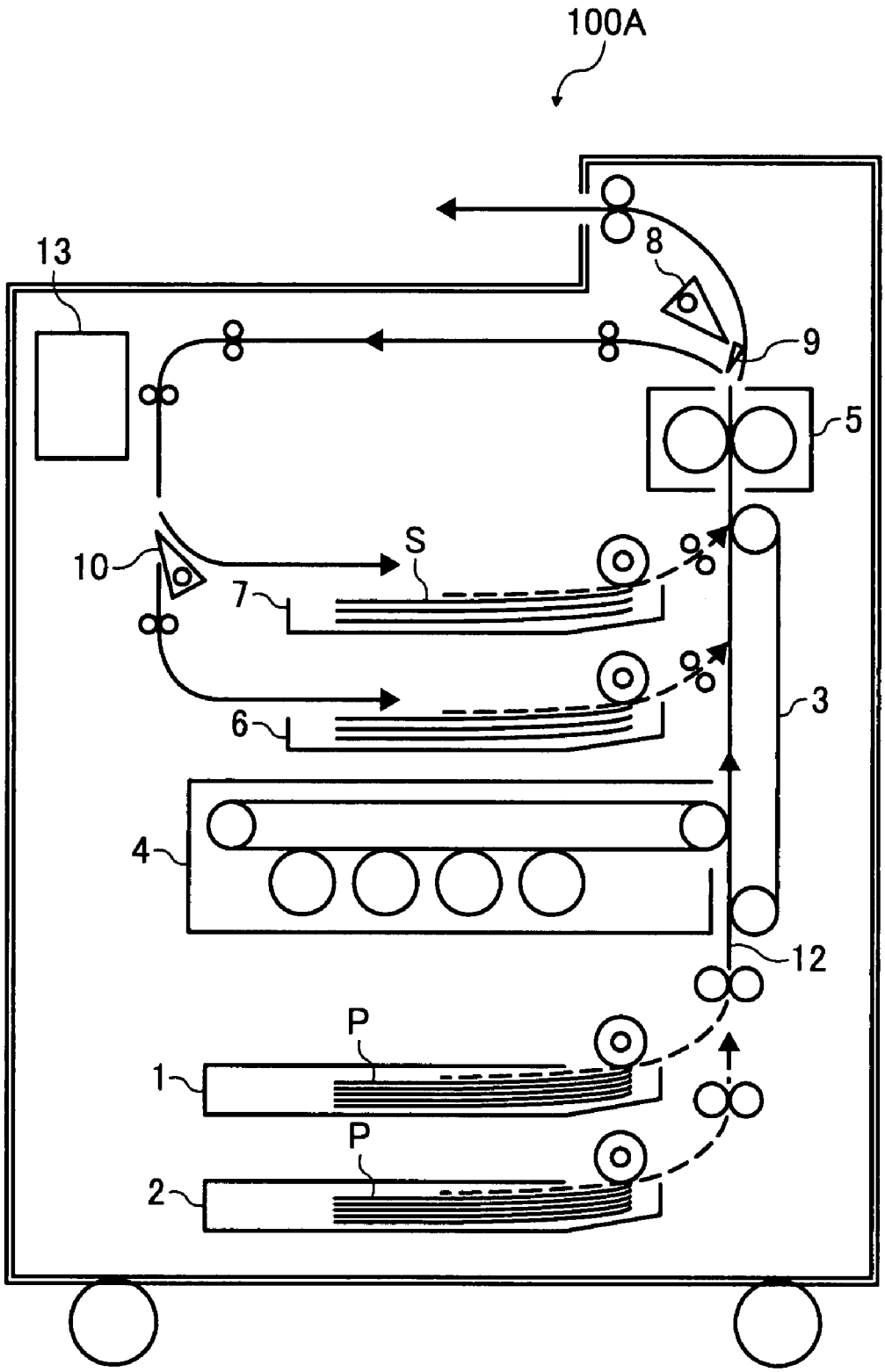
FIG. 3 is a schematic view of an image forming apparatus according to another example embodiment.

Referring to FIG. 3, the following describes an image forming apparatus 100A according to another example embodiment. As illustrated in FIG. 3, the image forming apparatus 100A includes a separator 9 and/or a conveyance path selector 10. The other elements of the image forming apparatus 100A are common to the image forming apparatus 100 (depicted in FIG. 1).

The separator 9 separates (e.g., strips) a gloss sheet S from a sheet P after the second fixing process. For example, after the fixing device 5 performs regular fixing for fixing a tentatively fixed toner image on a sheet P in a state that the toner image on the sheet P contacts a gloss sheet S, the separator 9 separates the gloss sheet S contacting the sheet P from the sheet P. The separated sheet P is output onto an outside of the image forming apparatus 100A.

The image forming apparatus 100A performs processes common to the image forming apparatus 100 until the second fixing process. For example, the fixing device 5 tentatively fixes a toner image on a sheet P in the first fixing process. The sheet P bearing the tentatively fixed toner image is sent to the storing tray 6 and temporarily stored in the storing tray 6. The sheet P is sent from the storing tray 6 to the fixing device 5 again. The fixing device 5 performs regular fixing for fixing the tentatively fixed toner image on the sheet P in a state that a gloss sheet S contacts the toner image on the sheet P in the second fixing process.

When the second fixing process is finished, the image forming apparatus 100A performs a process which is not common to the image forming apparatus 100. For example, the separator 9 separates the gloss sheet S from the sheet P. When the sheet P is conveyed near the separator 9, a nail of the separator 9 changes its position to separate the gloss sheet S from the sheet P. The gloss sheet S separated from the sheet P is conveyed on a conveyance path on which the sheet P bearing the tentatively fixed toner image is conveyed after the first fixing process. For example, the gloss sheet S is conveyed downward in the upper portion of the image forming apparatus 100A. The conveyance path selector 10 guides the gloss sheet S toward the gloss sheet tray 7. Namely, the gloss sheet S is returned to the gloss sheet tray 7 so that the gloss sheet S is repeatedly used. The conveyance path selector 8 guides the sheet P separated by the separator 9 from the gloss sheet S toward the outside of the image forming apparatus 100A. Thus, the sheet P is output onto the outside of the image forming apparatus 100A.

According to this non-limiting example embodiment, a user may pick up the sheet P bearing the fixed toner image and being separated from the gloss sheet S. Thus, the user needs not strip the gloss sheet S from the sheet P. The image forming apparatus 100A may provide a high quality image having an improved color reproduction and an increased image density.

Figure 4:
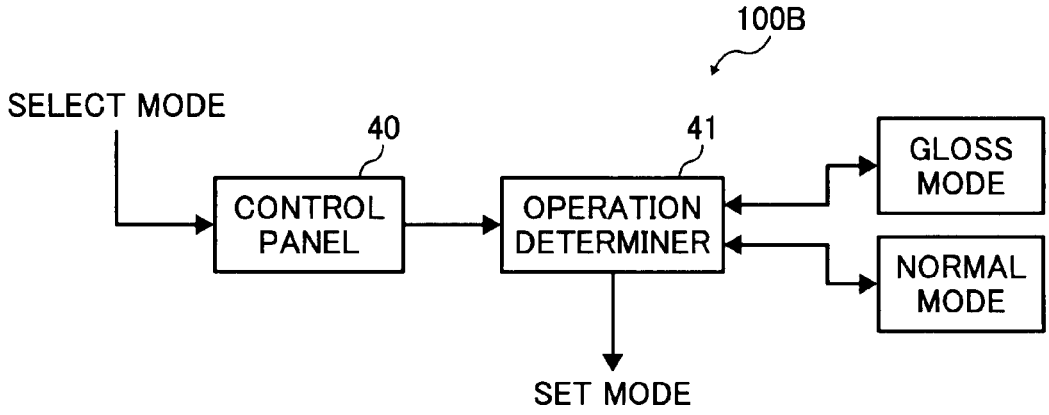
FIG. 4 is a block diagram of an example configuration of an image forming apparatus according to yet another example embodiment.

Referring to FIG. 4, the following describes an image forming apparatus 100B according to yet another example embodiment. As illustrated in FIG. 4, the image forming apparatus 100B includes a control panel 40 and/or an operation determiner 41. The other elements of the image forming apparatus 100B are common to the image forming apparatus 100 (depicted in FIG. 1) or the image forming apparatus 100A (depicted in FIG. 3).

According to this non-limiting example configuration, a user may select a gloss mode or a normal mode. In the gloss mode, the fixing device 5 (depicted in FIG. 1 or 3) performs regular fixing for fixing a tentatively fixed toner image on a sheet P in a state that a gloss sheet S contacts the toner image on the sheet P. After the regular fixing, the sheet P bearing the fixed toner image is output onto an outside of the image forming apparatus 100B. In the normal mode, the fixing device 5 performs tentative fixing for fixing a toner image on a sheet P without using a gloss sheet S. After the tentative fixing, the sheet P bearing the fixed toner image is output onto the outside of the image forming apparatus 100B. Namely, in the normal mode, the fixing device 5 does not perform regular fixing.

FIG. 4 is a block diagram of a determination process for selecting the gloss mode or the normal mode. A user selects the gloss mode or the normal mode by using the control panel 40. The operation determiner 41 invokes operations of the gloss mode or operations of the normal mode stored in the controller 13 (depicted in FIG. 1 or 3), and sets the mode (e.g., the gloss mode or the normal mode) selected by the user to the controller 13. The differences between the operations of the gloss mode and the operations of the normal mode include the difference in operations of the conveyance path selector 8 (depicted in FIG. 1 or 3) and the difference in conditions of tentative fixing and regular fixing. The differences are stored as the gloss mode and the normal mode. According to this non-limiting example embodiment, the control panel 40 is provided in the image forming apparatus 100B. However, the control panel 40 may be provided in an external device (e.g., a personal computer, an external controller, and/or the like). In this case, a keyboard of the external device may function as the control panel 40, for example.

Figure 5:
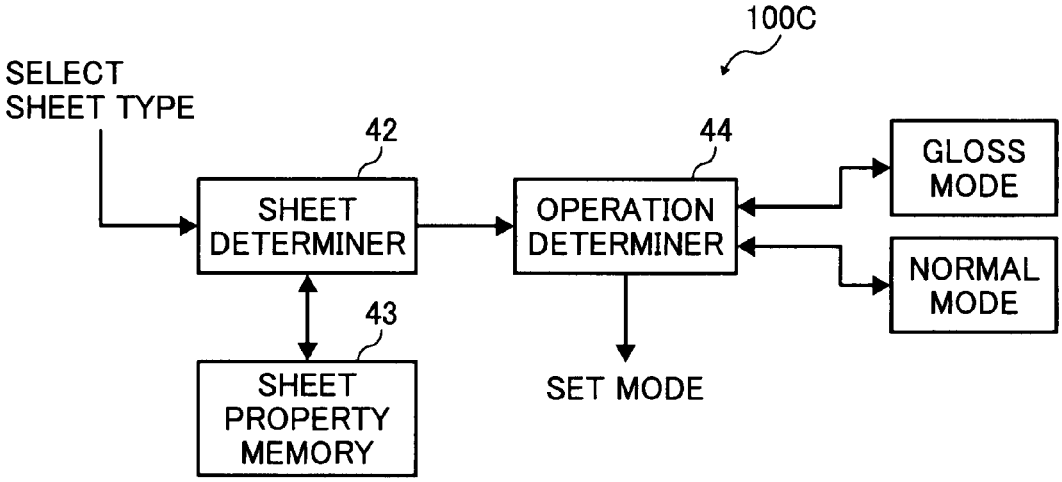
FIG. 5 is a block diagram of an example configuration of an image forming apparatus according to yet another example embodiment.

Referring to FIG. 5, the following describes an image forming apparatus 100C according to yet another example embodiment. As illustrated in FIG. 5, the image forming apparatus 100C includes a sheet determiner 42, a sheet property memory 43, and/or an operation determiner 44. The other elements of the image forming apparatus 100C are common to the image forming apparatus 100 (depicted in FIG. 1) or the image forming apparatus 100A (depicted in FIG. 3).

According to this non-limiting example configuration, a user does not directly select the gloss mode or the normal mode, but specifies a sheet property (e.g., sheet type and/or the like) of a sheet P. The sheet property memory 43 stores properties (e.g., information) of sheets. The sheet determiner 42 refers to the properties stored in the sheet property memory 43 to determine which mode (e.g., the gloss mode or the normal mode) is appropriate for a sheet P based on the sheet property of the sheet P.

For example, when a user selects sheet type (e.g., plain paper, coated paper, and/or the like) of a sheet P, the sheet determiner 42 refers to the properties stored in the sheet property memory 43, and determines which mode (e.g., the gloss mode or the normal mode) is appropriate for the sheet P based on the sheet type of the sheet P selected by the user. The operation determiner 44 invokes operations of the gloss mode or operations of the normal mode stored in the controller 13 (depicted in FIG. 1 or 3), and sets the mode (e.g., the gloss mode or the normal mode) determined by the sheet determiner 42 to the controller 13.

Figure 6:
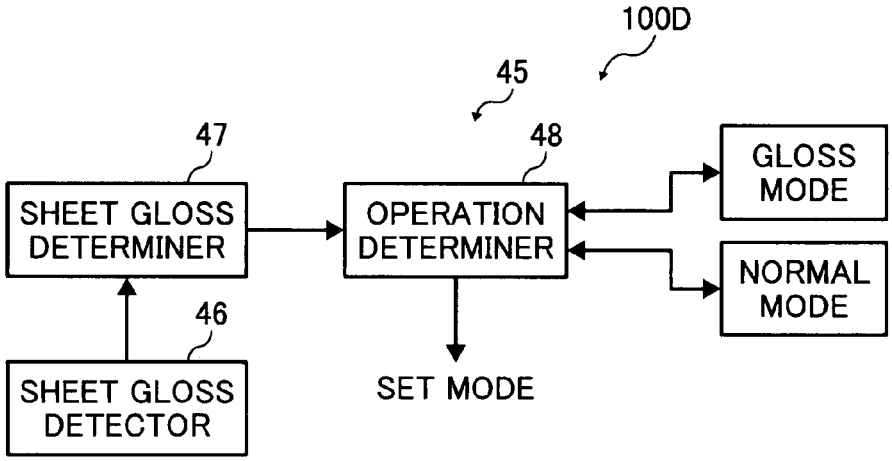
FIG. 6 is a block diagram of an example configuration of an image forming apparatus according to yet another example embodiment.

Referring to FIG. 6, the following describes an image forming apparatus 100D according to yet another example embodiment. As illustrated in FIG. 6, the image forming apparatus 100D includes a gloss detector 45. The gloss detector 45 includes a sheet gloss detector 46, a sheet gloss determiner 47, and/or an operation determiner 48. The other elements of the image forming apparatus 100D are common to the image forming apparatus 100 (depicted in FIG. 1) or the image forming apparatus 100A (depicted in FIG. 3).

The gloss detector 45 selects the gloss mode or the normal mode based on a gloss of a sheet P. For example, the sheet gloss detector 46 detects a gloss of a sheet P. The sheet gloss determiner 47 determines the gloss of the sheet P based on a detection result provided by the sheet gloss detector 46. The operation determiner 48 invokes operations of the gloss mode or operations of the normal mode stored in the controller 13 (depicted in FIG. 1 or 3) based on the gloss of the sheet P determined by the sheet gloss determiner 47, and sets the mode (e.g., the gloss mode or the normal mode) determined by the sheet gloss determiner 47 to the controller 13.

Figure 7:
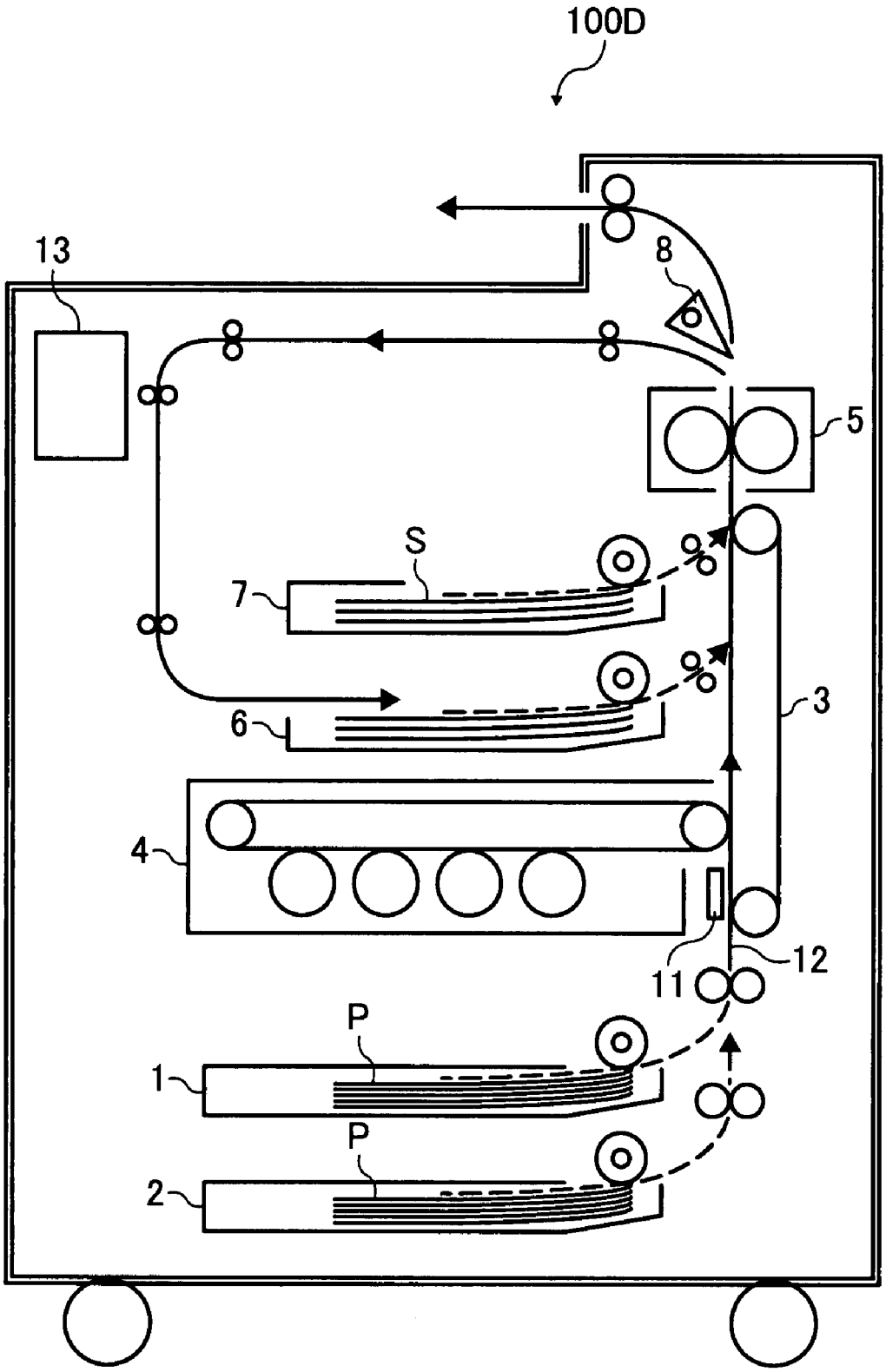
FIG. 7 is a schematic view (according to an example embodiment) of the image forming apparatus shown in FIG. 6.

FIG. 7 illustrates the image forming apparatus 100D. As illustrated in FIG. 7, the image forming apparatus 100D further includes a gloss sensor 11. The other elements of the image forming apparatus 100D are common to the image forming apparatus 100 (depicted in FIG. 1) or the image forming apparatus 100A (depicted in FIG. 3).

The gloss sensor 11 detects a gloss of a sheet P by detecting a size of regular reflection light. The gloss sensor 11 opposes the conveying path 12 and serves as the sheet gloss detector 46 (depicted in FIG. 6). In the image forming apparatus 100D, the gloss mode or the normal mode is selected based on a detection result provided by the gloss sensor 11.

Figure 8:
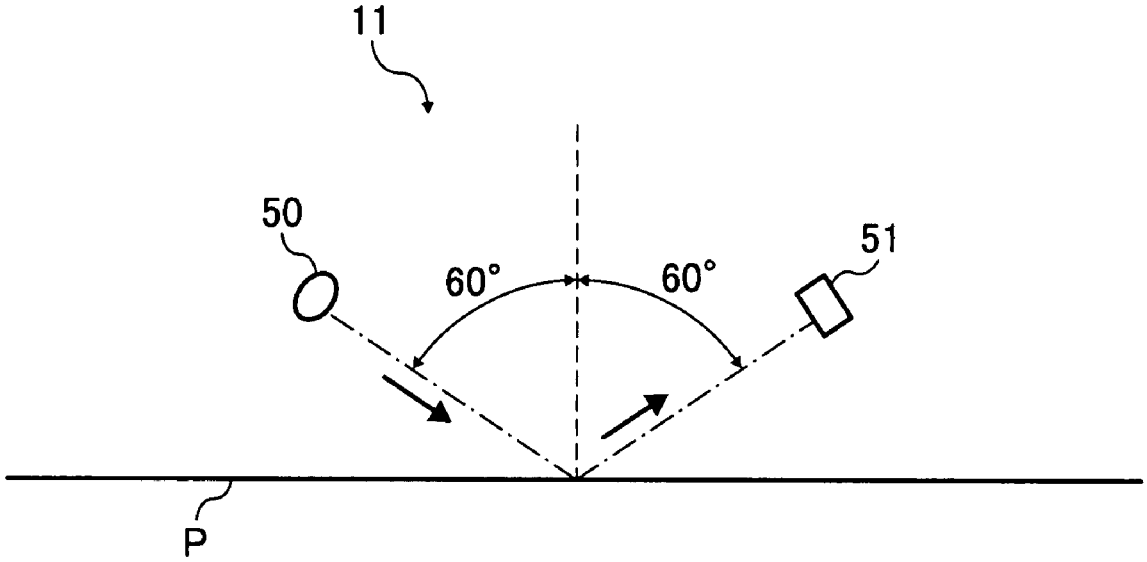
FIG. 8 is a sectional view (according to an example embodiment) of a gloss sensor of the image forming apparatus shown in FIG. 7.

FIG. 8 illustrates the gloss sensor 11. As illustrated in FIG. 8, the gloss sensor 11 includes a light emitter 50 and/or a light receiver 51. The light emitter 50 includes a tungsten filament lamp. The light emitter 50 emits light at an incident angle of about 60 degrees onto a sheet P. The light receiver 51 is disposed at a position where the light receiver 51 receives the light (e.g., regular reflection light) reflected by the sheet P at an output angle of about 60 degrees. The light receiver 51 includes a photodiode element.

According to this non-limiting example embodiment, the gloss mode or the normal mode is properly selected in accordance with a gloss of a sheet P. Thus, a toner image on a sheet P may provide a high quality image fitting the sheet P and having an improved color reproduction and an increased image density.

As described above, in an image forming apparatus (e.g., the image forming apparatus 100, 10A, 100B, 100C, or 100D depicted in FIG. 1, 3, 4, 5, or 7, respectively), a single fixing device (e.g., the fixing device 5 depicted in FIG. 1, 3, or 7) performs the first and second fixing processes. Therefore, the image forming apparatus may have a compact size occupying a decreased space. The fixing device uses a gloss sheet (e.g., a gloss sheet S depicted in FIG. 1, 3, or 7) separately provided from a heater (not shown) of the fixing device so as to cool and separate a recording sheet (e.g., a sheet P depicted in FIG. 1, 3, or 7) from the fixing device, resulting in decreased surface asperities and an increased gloss of a toner image formed on the recording sheet. Since the fixing device uses the gloss sheet, the fixing device does not include a fixing belt (not shown) having a cool area for cooling the recording sheet. Generally, a fixing device including the fixing belt having the cool area is large in a sheet conveyance direction, causing the fixing device to have a large size. On the contrary, the fixing device according to the above-described example embodiments needs not include the cool area, and thereby has a compact size. Accordingly, the image forming apparatus including the compact size fixing device may have a compact size.

Since the single fixing device performs the first and second fixing processes, a recording sheet on which the first fixing process is performed in the fixing device returns to the fixing device for the second fixing process. For example, the recording sheet is conveyed via a long conveying path to an upstream side from the fixing device in a sheet conveyance direction. When the image forming apparatus does not include a sheet storing member (e.g., the storing tray 6 depicted in FIG. 1, 3, or 7), recording sheets need to be conveyed one by one on the long conveying path. For example, a next recording sheet is conveyed to the fixing device for the first fixing process after a previous recording sheet returns to the fixing device for the second fixing process. Otherwise, the next recording sheet conveyed toward the fixing device for the first fixing process collides with the previous recording sheet conveyed toward the fixing device for the second fixing process at the upstream side from the fixing device in the sheet conveyance direction. Namely, when the image forming apparatus does not include the sheet storing member, a substantial distance is needed between the previous and next recording sheets, preventing efficient printing.

To address this problem, the image forming apparatus according to the above-described example embodiments includes the sheet storing member. The sheet storing member stores the previous recording sheet on which the first fixing process is performed before the previous recording sheet returns to the upstream side from the fixing device in the sheet conveyance direction for the second fixing process. Thus, even when a small distance is provided between the previous and next recording sheets, the previous and next recording sheets may not collide with each other. As a result, the image forming apparatus may provide efficient printing and an increased productivity at an increased print speed.

A recording sheet passes the fixing device so that the fixing device performs the first fixing process to tentatively fix a toner image on the recording sheet. The sheet storing member temporarily stores the recording sheet bearing the tentatively fixed toner image. The recording sheet bearing the tentatively fixed toner image passes the fixing device again so that the fixing device performs the second fixing process to fix the tentatively fixed toner image on the recording sheet in a state that the toner image contacts a gloss sheet. The sheet storing member temporarily stores the recording sheet bearing the tentatively fixed toner image before the recording sheet is conveyed to the fixing device for the second fixing process. Therefore, while the sheet storing member stores the recording sheet, fixing conditions set for the first fixing process may be changed for the second fixing process. For example, a fixing temperature for the second fixing process may be different from a fixing temperature for the first fixing process. Thus, fixing conditions appropriate for the first and second fixing processes, respectively, may be set. When a gloss sheet is used to cool and separate a recording sheet, a toner image on the recording sheet may not be easily heated in the second fixing process due to an increased heat capacity provided by the gloss sheet. Therefore, different fixing temperatures are generally applied as fixing temperatures for the first and second fixing processes, respectively. When the image forming apparatus includes the sheet storing member, a single switch of fixing conditions may set different fixing conditions for the first and second fixing processes, respectively, resulting in an improved energy efficiency compared to a configuration in which the sheet storing member is not provided and thereby fixing conditions are switched whenever a recording sheet passes the fixing device. As a result, the image forming apparatus may save energy.

when the fixing temperature is repeatedly increased and decreased to a target temperature, a recording sheet is not conveyed to the fixing device until the fixing device or a fixing roller (e.g., the fixing roller 33 depicted in FIG. 1) reaches the target temperature. Thus, a standby time period may be needed or increased. According to the above-described example embodiments, the sheet storing member stores a plurality of recording sheets bearing a toner image tentatively fixed in the first fixing process, and the plurality of recording sheets are conveyed together to the fixing device for the second fixing process. Accordingly, fixing conditions need not be repeatedly switched. As a result, the image forming apparatus may provide a shortened standby time period, efficient printing, and an increased productivity at an increased print speed.

The fixing device uses a gloss sheet instead of a fixing belt to apply gloss to a toner image on a recording sheet. When the fixing belt is used for a long time period, the fixing belt may be damaged or may wear. On the contrary, the gloss sheet may be used when a user adds gloss to a toner image on a recording sheet. Namely, the user may not use the gloss sheet when the user does not add gloss to a toner image on a recording sheet, reducing wear of the gloss sheet. The user replaces the gloss sheet instead of the fixing belt with new one, reducing costs. According to the above-described example embodiments, even when the gloss sheet is repeatedly used for a long time period, wear of the gloss sheet may be reduced. Accordingly, the image forming apparatus may provide an increased endurance.

The first and second fixing processes are performed under different fixing conditions, respectively. Thus, the image forming apparatus may form a toner image having a proper gloss. The second fixing process is performed with a gloss sheet which is not used for the first fixing process. Therefore, the second fixing process consumes a greater amount of heat than the first fixing process. Accordingly, proper fixing conditions for the second fixing process differ from proper fixing conditions for the first fixing process. Thus, according to the above-described example embodiments, the image forming apparatus performs the first and second fixing processes under different fixing conditions, respectively.

Even when the different fixing conditions are applied to the first and second fixing processes, respectively, switching of the fixing conditions may be performed once, because the sheet storing member stores recording sheets bearing a toner image tentatively fixed in the first fixing process before the recording sheets are conveyed to the fixing device for the second fixing process. For example, after the first fixing process is performed on a plurality of recording sheets as needed, fixing conditions may be changed to fit the second fixing process and the second fixing process is performed on the plurality of recording sheets. Namely, switching of the fixing conditions may be performed once, providing more efficient printing compared to a configuration in which the fixing conditions are switched for every recording sheet. Thus, the image forming apparatus may provide an increased productivity.

The first and second fixing processes are performed under different fixing temperatures, respectively. Thus, proper fixing may be performed in each of the first fixing process and the second fixing process using a gloss sheet and thereby using an increased amount of heat compared to the first fixing process. As a result, the image forming apparatus may form a toner image having an increased image density and an improved uniform gloss.

The first and second fixing processes are performed at different fixing speeds, respectively. Thus, different amounts of heat are applied to a recording sheet in the first and second fixing processes, respectively, because the second fixing process uses a gloss sheet and thereby uses an increased amount of heat compared to the first fixing process. As a result, proper fixing may be performed both in the first fixing process and the second fixing process. Namely, the image forming apparatus may form a toner image having an increased image density and an improved uniform gloss.

A fixing condition controller (e.g., the controller 13 depicted in FIG. 1, 3, or 7) changes a pressure applied to a recording sheet in the fixing device. Thus, the image forming apparatus may form a toner image having decreased surface asperities and an increased gloss. In the second fixing process, the fixing device applies a pressure to a recording sheet via a gloss sheet. For example, an increased pressure is applied to a recording sheet so that a toner image on the recording sheet tightly contacts a gloss sheet. Thus, a gloss surface of the gloss sheet is transferred onto a surface of the toner image on the recording sheet. Therefore, the fixing device may apply a greater pressure to the recording sheet in the second fixing process than in the first fixing process. The fixing condition controller controls a pressure applied to the recording sheet in the second fixing process to provide a proper fixing condition. As a result, the image forming apparatus may form a toner image having proper surface asperities and an improved gloss.

A recording sheet bearing a fixed toner image may be output onto an outside of the image forming apparatus after the image forming apparatus separates a gloss sheet from the recording sheet. Namely, the image forming apparatus may form a high quality image without causing a user to separate the gloss sheet from the recording sheet. An example background image forming apparatus outputs a recording sheet onto an outside of the background image forming apparatus without separating a gloss sheet from the recording sheet so as to provide a value to a user. However, when a user finds a value in a recording sheet bearing a toner image output after being separated from a gloss sheet, the user may regard a task for separating the gloss sheet from the recording sheet as a burden. To address this problem, the image forming apparatus according to the above-described example embodiments frees the user from the task.

The image forming apparatus provides two modes for fixing. For example, the user may select the gloss mode for performing the first and second fixing processes or the normal mode for performing the first fixing process. Thus, the image forming apparatus may form a toner image having balanced quality between image quality and print speed. When plain paper having increased surface asperities and a decreased gloss is used as a recording sheet, a toner image on the recording sheet may not have uniform surface asperities. The normal mode may be selected for plain paper so as to print a toner image on a recording sheet at an increased speed and to provide a user with improved user-friendliness.

The image forming apparatus further includes a control panel (e.g., the control panel 40 depicted in FIG. 4) with which a user selects the gloss mode or the normal mode. Namely, the user operates the control panel to switch the mode between the gloss mode and the normal mode. Thus, the image forming apparatus may provide balanced quality between image quality and print speed and may form a toner image satisfying a request of the user.

The image forming apparatus further includes a sheet determiner (e.g., the sheet determiner 42 depicted in FIG. 5) for switching the mode between the gloss mode and the normal mode based on sheet type of a recording sheet. Thus, the image forming apparatus may provide balanced quality between image quality and print speed and may form a toner image satisfying a request of a user.

The image forming apparatus further includes a gloss detector (e.g., the gloss detector 45 depicted in FIG. 6) for switching the mode between the gloss mode and the normal mode based on a detection result (e.g., a gloss of a recording sheet). Thus, the image forming apparatus may provide balanced quality between image quality and print speed and may form a toner image satisfying a request of a user.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An image forming apparatus, comprising:

a fixing device to tentatively fix a toner image on a recording sheet and to further fix the tentatively fixed toner image by contacting a gloss sheet onto the tentatively fixed toner image on the recording sheet; and a sheet storing member to temporarily store the recording sheet bearing the tentatively fixed toner image before the recording sheet is sent to the fixing device for the further fixing.

2. The image forming apparatus according to claim 1, further comprising:

a fixing condition controller to change a fixing condition of the fixing device while the sheet storing member stores the recording sheet bearing the tentatively fixed toner image.

3. The image forming apparatus according to claim 2, wherein the fixing condition controller is usable to change a fixing temperature of the fixing device.

4. The image forming apparatus according to claim 2, wherein the fixing condition controller is usable to change a fixing speed of the fixing device.

5. The image forming apparatus according to claim 2, wherein the fixing condition controller is usable to change a pressure applied by the fixing device to the recording sheet.

6. The image forming apparatus according to claim 1, further comprising:

a separator to separate the gloss sheet from the recording sheet after the fixing device performs the further fixing on the recording sheet.

7. The image forming apparatus according to claim 1, further comprising:

a gloss mode to output the recording sheet after the fixing device performs the further fixing on the recording sheet bearing the tentatively fixed toner image; and a normal mode to output the recording sheet after the fixing device performs the tentative fixing on the recording sheet bearing the toner image, the normal mode being a mode in which the fixing device does not perform the further fixing.

8. The image forming apparatus according to claim 7, further comprising:

a control panel, operatable by a user, to switch the mode between the gloss mode and the normal mode.

9. The image forming apparatus according to claim 7, further comprising:

a sheet determiner to switch the mode between the gloss mode and the normal mode based on sheet type of the recording sheet.

10. The image forming apparatus according to claim 7, further comprising:

a gloss detector to detect a gloss of the recording sheet, a mode being switchable between the gloss mode and the normal mode based on the detected gloss of the recording sheet.

11. An image forming method, comprising:

tentatively fixing a toner image on a recording sheet using a fixing device;

sending the recording sheet bearing the tentatively fixed toner image to a sheet storing member;

temporarily storing the recording sheet sent from the fixing device in the sheet storing member;

sending the recording sheet from the sheet storing member to the fixing device; and regular-fixing the tentatively fixed toner image, by contacting a gloss sheet onto the tentatively fixed toner image on the recording sheet, with the fixing device.

12. The image forming method according to claim 11, further comprising:

changing a fixing condition of the fixing device, while the sheet storing member stores the recording sheet bearing the tentatively fixed toner image, with a fixing condition controller.

13. The image forming method according to claim 12, wherein the fixing condition controller changes a fixing temperature of the fixing device.

14. The image forming method according to claim 12, wherein the fixing condition controller changes a fixing speed of the fixing device.

15. The image forming method according to claim 12, wherein the fixing condition controller changes a pressure applied by the fixing device to the recording sheet.

16. The image forming method according to claim 11, further comprising:

separating the gloss sheet from the recording sheet after the fixing device performs the regular fixing on the recording sheet.

17. The image forming method according to claim 11, further comprising:

switching a mode between a gloss mode and a normal mode, wherein the gloss mode outputs the recording sheet after the fixing device performs the regular fixing on the recording sheet bearing the tentatively fixed toner image, and the normal mode outputs the recording sheet after the fixing device performs the tentative fixing on the recording sheet bearing the toner image without performing the regular fixing.

18. The image forming method according to claim 17, wherein a user operates a control panel to switch the mode between the gloss mode and the normal mode.

19. The image forming method according to claim 17, wherein a sheet determiner switches the mode between the gloss mode and the normal mode based on sheet type of the recording sheet.

20. The image forming method according to claim 17, wherein a gloss detector detects a gloss of the recording sheet to switch the mode between the gloss mode and the normal mode based on the detected gloss of the recording sheet.

* * * * *